US011241711B2

(12) United States Patent
Coonce et al.

(10) Patent No.: US 11,241,711 B2
(45) Date of Patent: Feb. 8, 2022

(54) BUFF-COATED ARTICLE AND METHOD OF MAKING THE SAME

(71) Applicant: 3M INNOVATIVE PROPERTIES COMPANY, St. Paul, MN (US)

(72) Inventors: Benjamin R. Coonce, South Saint Paul, MN (US); Morgan A. Priolo, Woodbury, MN (US); Megan A. Creighton, Dayton, OH (US); Emily S. Goenner, Shoreview, MN (US); Daniel J. O'Neal, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 100 days.

(21) Appl. No.: 16/490,343

(22) PCT Filed: Feb. 15, 2018

(86) PCT No.: PCT/US2018/018362
§ 371 (c)(1),
(2) Date: Aug. 30, 2019

(87) PCT Pub. No.: WO2018/175022
PCT Pub. Date: Sep. 27, 2018

(65) Prior Publication Data

US 2020/0070200 A1 Mar. 5, 2020

Related U.S. Application Data

(60) Provisional application No. 62/474,775, filed on Mar. 22, 2017.

(51) Int. Cl.
*B05D 1/28* (2006.01)
*B41M 1/04* (2006.01)

(52) U.S. Cl.
CPC ..... *B05D 1/28* (2013.01); *B41M 1/04* (2013.01); *B05D 2201/02* (2013.01);
(Continued)

(58) Field of Classification Search
CPC .. B05D 1/28; B05D 2201/02; B05D 2401/32; B05D 2401/40; B05D 2451/00; B05D 2201/00; B41M 1/04
See application file for complete search history.

(56) References Cited

U.S. PATENT DOCUMENTS 2,758,948 A 8/1956 Simon
3,369,268 A 2/1968 Burns
(Continued)

FOREIGN PATENT DOCUMENTS

WO WO 2010-025052 3/2010
WO WO-2014207103 A1 * 12/2014 ..... B05D 5/02
(Continued)

OTHER PUBLICATIONS

Calvert, "Aerodynamic Dispersion of Cohesive Powders: A Review of Understanding And Technology", Advanced Powder Technology, 2009, vol. 20, pp. 04-16.
(Continued)

*Primary Examiner* — Alexander M Weddle
(74) *Attorney, Agent, or Firm* — Bradford B. Wright

(57) ABSTRACT

A method of making a buff-coated article includes disposing a tie layer on at least a portion of a major surface of a substrate and buff-coating a powder onto at least a portion of the tie layer. Buff-coated articles are also disclosed.

11 Claims, 1 Drawing Sheet

(52) U.S. Cl.
CPC ..... *B05D 2401/32* (2013.01); *B05D 2401/40* (2013.01); *B05D 2451/00* (2013.01)

(56) References Cited

U.S. PATENT DOCUMENTS

| | | | | |
|---|---|---|---|---|
| 4,539,256 | A | 9/1985 | Shipman | |
| 4,652,274 | A | 3/1987 | Boettcher | |
| 4,741,918 | A | 5/1988 | Nagy de Nagybaczon | |
| 4,751,138 | A | 6/1988 | Tumey | |
| 4,903,440 | A | 2/1990 | Larson | |
| 5,178,646 | A | 1/1993 | Barber, Jr | |
| 5,236,472 | A | 8/1993 | Kirk | |
| 5,378,252 | A | 1/1995 | Follensbee | |
| 5,580,647 | A | 12/1996 | Larson | |
| 6,025,014 | A | 2/2000 | Stango | |
| 6,511,701 | B1 | 1/2003 | Divigalpitiya | |
| 2012/0024470 | A1 | 2/2012 | Hundorf | |
| 2012/0137911 | A1* | 6/2012 | Pekurovsky | B41F 23/04 101/491 |
| 2013/0087289 | A1 | 4/2013 | Ogasawara | |
| 2013/0136923 | A1* | 5/2013 | Divigalpitiya | C01B 32/205 428/367 |
| 2015/0118457 | A1* | 4/2015 | Divigalpitiya | H01B 13/0036 428/206 |

FOREIGN PATENT DOCUMENTS

| | | |
|---|---|---|
| WO | WO 2015-126709 | 8/2015 |
| WO | WO 2016-154195 | 9/2016 |
| WO | WO 2016-203247 | 12/2016 |
| WO | WO 2019-003153 | 1/2019 |

OTHER PUBLICATIONS

Clough, "High-Energy Radiation And Polymers: A Review of Commercial Processes And Emerging Applications", Nuclear Instruments and Methods in Physics Research Section B: Beam Interactions with Materials and Atoms, 2001, vol. 185, pp. 08-33.

Kim, "Self-Healing Reduced Graphene Oxide Films by Supersonic Kinetic Spraying", Advanced Functional Materials, 2014, vol. 24, pp. 4986-4995.

International Search Report for PCT International Application No. PCT/US2018/018362, dated May 24, 2018, 4 pages.

* cited by examiner

BUFF-COATED ARTICLE AND METHOD OF MAKING THE SAME

TECHNICAL FIELD

The present disclosure relates to methods for coating a powder onto a substrate to form a buff-coated substrate, and buff-coated substrates made thereby.

BACKGROUND

Various methods of bonding powders to web substrate substrates (e.g., plastic film) in the form of a thin adherent coating have been known for many years. In one technique, the powder is applied to the surface of the web substrate and buffed until it becomes adherent. This general coating technique is hereinafter referred to as "buff-coating", and the resultant coating as a "buff-coat".

One such buff-coating method is described in U.S. Pat. No. 6,511,701 B1 (Divigalpitiya et al.). In it random orbital buffing machines were used to buff-coat various soft powders onto a web substrate surface. While a drill-powered paint roller loaded with powder was also used, it gave poor quality coatings. However, the method has practical limitations with respect to manufacturing speed.

U.S. Pat. No. 4,741,918 (Nagybaczon et al.) describes a method of coating dry discrete particles onto the surface of a substrate using a soft, resilient buffing wheel. Certain organic polymers, metals, metal oxides, minerals, diamond, china clay, pigments, and metalloid elements are disclosed as suitable materials for the coating method.

One problem plaguing the above methods is that the maximum level of powder deposition that can be achieved is generally dependent on the material nature of the powder and the substrate. There remains a need from improved methods (e.g., faster and/or more uniform) for buff-coating powders onto a wide variety of substrates.

SUMMARY

Advantageously, by using a variably partially cured tie coat the present disclosure provides a tunable method for controlling (e.g., increasing or decreasing) the amount of buff-coat deposition on a wide variety of substrates.

In a first aspect, the present disclosure provides a method of making a buff-coated article, the method comprising the sequential steps:

a) providing a substrate having a major surface;

b) disposing a tie layer on at least a portion of the major surface; and c) buff-coating a powder onto at least a portion of the tie layer.

In some embodiments steps a) to c) are consecutive, while in others they are not (e.g., having an intervening step between steps b) and c).

In a second aspect, the present disclosure provides a buff-coated article comprising:

a substrate having a major surface;

a tie layer disposed on at least a portion of the major surface; and a buff-coated powder layer disposed on at least a portion of the tie layer.

As used herein:

"buff-coat" refers to a coating formed by buff-coating a powder;

"buff-coating" means frictionally contacting a powder with a surface of a substrate under buffing conditions such that some of the powder adheres to the surface of the substrate;

the terms "cure", "cured", and "curable" refer to curing that occurs by formation of a cross-linked polymer network;

B-stage refers to an intermediate stage in a thermosetting resin reaction in which the thermosetting resin is rendered nonflowable, swells but does not dissolve in contact with certain liquids, but has not polymerized to fully cured state;

C-stage refers to a fully cured (at ambient temperature, e.g., at 20° C.) state of a thermosetting resin; and partially cured means cured to at least the point of a B-stage cure but not the C-stage.

The modifier "(s)" following a noun indicates that the noun may be singular or plural.

The term "(meth)acrylate" includes acrylate and/or methacrylate.

Features and advantages of the present disclosure will be further understood upon consideration of the detailed description as well as the appended claims.

Figure 1:
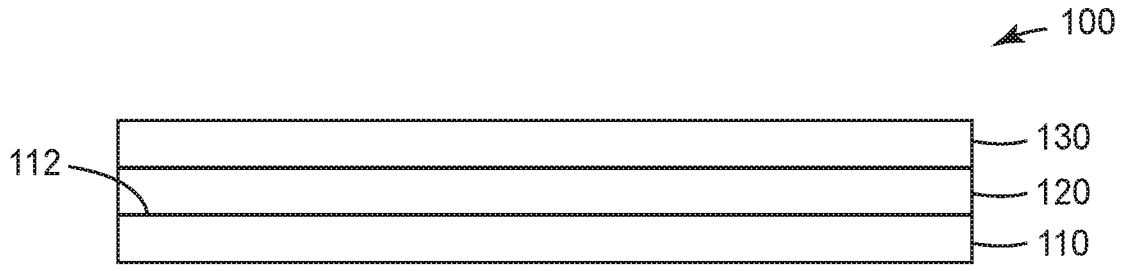
FIG. 1 is a schematic side view of an exemplary buff-coated article 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

An exemplary sequential process according to the present disclosure involves providing a substrate having a major surface. A tie layer is disposed on at least a portion of the major surface. Powder is buff-coated onto at least a portion of the tie layer. The tie layer thus may provide improved (e.g., secure) bonding between the buff-coat layer and the major surface of the substrate.

Exemplary substrates include metal, wood, ceramics, and plastics. The substrate should have at least one major surface, preferably two opposed major surfaces (e.g., sheets and roll goods coated as webs). The substrate may be porous or nonporous. One exemplary class of substrates includes porous or microporous polymers membrane, such as disclosed in U.S. Pat. No. 4,539,256 (Shipman). Preferably, the substrate comprises a thermoplastic film (e.g., as a sheet or web). Exemplary thermoplastics include polyesters (e.g., polyethylene terephthalate, polylactic acid, or polycaprolactone), polyolefins (e.g., homo- and co-polymers of propylene, biaxially-oriented polypropylene, ethylene (e.g., ultra-high molecular weight polyethylene, high density polyethylene, medium density polyethylene, or low density polyethylene), butadiene, and styrene), polycarbonates, polyimides (e.g., also including polyetherimides and polyetheretherimides), cellulosic esters (e.g., cellulose acetate and cellulose butyrate), polyamides (e.g., nylon-6 and nylon-6,6), polyvinyl chloride, and acrylics (e.g., polymethyl methacrylate and polyacrylonitrile).

The substrate may be relatively smooth in nature, or alternatively may be provided with macro and/or micro topography. One exemplary surface topography includes grooves, channels, posts, mushrooms, hooks, or the like, having depths of about 10-2000 microns and width of between 10-2000 microns.

Powders suitable for buff-coating (i.e., buff-coatable powders) preferably comprise particles having a Mohs hardness of 3 or less, more preferably 0.4 to 2.5. Examples include powders comprising carbon black, graphite, hexagonal boron nitride, sulfur, tungsten disulfide, polytetrafluoroethylene, polyvinylidene difluoride, ULTEM oligomer (polyetherimide resin), zeolites (e.g., silver zeolites), 1-ascorbic acid), silver chloride, silver sulfadiazine, amino acids, and clays (e.g., phyllosilicate clays such as kaolin clays, smectite clays, illite clays, chlorite clays, sepiolite, attapulgite, montmorillonite clays, and synthetic clays).

Preferred powders comprise exfoliatable particles. For purposes of the present disclosure, the term "exfoliatable particle" means a particle that breaks up into flakes, scales, sheets or layers upon application of shear force. Particularly preferred exfoliatable materials include graphite, MoS2 (molybdenum disulfide), WS2 (tungsten disulfide), clays and h-BN (hexagonal boron nitride). Preferred buffable powders of the present disclosure are powders having a largest dimension of less than 100 microns. Mixtures of the above materials can also be buffed to form coatings of desired characteristics.

A particle is considered to have a low affinity for a substrate if the particles will not stay on the substrate by themselves if buff-coated onto the substrate using methods of the present disclosure.

Such low affinity particles (buffing aid particles) may serve as a buff-coating aid when mixed with particles of higher affinity (e.g., exfoliatable) particles. Low affinity particles tend to separate from exfoliatable particles during the buffing process, and help the distribution and uniformity of higher affinity particles on the substrate. Typically, little or no buffing aid particles remain on the final coated product. Examples of such buffing aid particles include Radiant MP series encapsulated dye particles from Radiant Color Co. (Richmond, Calif.), such as magenta, MP orange, MP chartreuse, and clear particles. Other buffing aid particles include Methyl Red dye particles having a CAS number of 493-52-7, Methylene Blue dye particles having a CAS number of 75-09-2, Perylene Red pigment, Rhodamine B dye having a CAS number of 81-88-9, Malachite Green oxalate having a CAS number of 2437-29-8, and Azure A dye having a CAS number of 531-53-3. In some preferred embodiments, magnetic toner particles may be used as buffing aid particles. These particles may be particularly advantageous, because excess particles can be easily removed from the work area with a magnet.

In another embodiment, the buffing aid particles have at least some affinity for higher affinity particles. In this embodiment, the buffing aid particles in addition to assisting in the distribution and uniformity of the coating of higher affinity particles are themselves incorporated into the coating on the substrate. Examples of such buffing aids include copper phthalocyanine having a CAS number of 147-14-8, Permanent Red pigment from Magruder Color Company Inc., Elizabeth, N.J., Rose Bengal Stain having a CAS number of 632-69-9, Furnace Black carbon particles having a CAS number of 1333-86-4, Azure B dye having a CAS number of 531-55-5, Methyl Orange dye having a CAS number of 547-58-0, Eosin Y dye having a CAS number of 17372-87-1, Basic Fuchsin dye having a CAS number of 569-61-9, and ceramic particles such as ZEEOSPHERES ceramic particles from 3M Company, St. Paul, Minn.

Mixtures of the above materials can also be used to form buff-coatings of various characteristics. For example, by varying the proportion of the constituents in the mixture changes in the surface properties (e.g., surface conductivity, optical density, gloss, or reflectance) can be obtained.

Buff-coating methods according to the present disclosure preferably provide a buff-coating composed of buff-coated powder without the presence of binder (e.g., an organic binder resin or polymer), although this is not a requirement.

Since buff-coats prepared according to the present disclosure are typically soft materials, it may be desirable to dispose a hard coat over it if it is to be subjected to repeated handling to protect the coating from scratches and other surface damage. A conventional hard coat well-known in the art may be applied onto the article in a variety of ways, for example, die coating a water-based polyurethane formulation, or an electromagnetic radiation (e.g., ultraviolet-visible light) cured acrylic hardcoat.

The tie layer may comprise any suitable material such as for example one or more organic polymers, one or more inorganic materials, and combinations thereof.

Exemplary materials for inclusion in the tie layer include silica (including organosilica) particles and coatings, and polymers such as polyurethane(s), acrylic polymer(s), polyamide(s), polyester(s), polycarbonate(s), rubber(s), polyolefins (e.g., polystyrenes and styrene block co-polymers with butadiene), blends and copolymers thereof.

The tie layer may be coated out of solvent (e.g., organic solvent(s), water, and combinations thereof) following by a drying step, or it may be coated without inert solvent present. Exemplary organic solvents include alcohols, ethers, ketones, and combinations thereof.

In some preferred embodiments, the tie layer comprises at least one curable material. Useful curable materials preferably polymerize and/or crosslink upon exposure to heat, e-beam, ultraviolet light, visible light or upon the addition of a chemical catalyst, photoinitiator, moisture, or a combination thereof. During manufacturing, the curable material is exposed to the appropriate conditions to initiate at least partial curing of the curable material. Useful curable materials may include a combination of curable compounds (e.g., one or more free-radically polymerizable monomers and/or one or more epoxy monomers). Preferably, the tie layer is non-tacky at ambient temperature In some preferred embodiments, the curable material comprises partially cured (meth)acrylic monomer(s) and/or oligomer(s). By controlling the degree of polymerization, it is possible to affect the amount of powder deposited on the tie layer under the same buffing conditions. Advantageously, it is hence possible to prepare a wide variety of tie layers from a relatively simple precursor composition, simply by adjusting cure conditions.

Upon fully curing the curable material, if performed, B-staged material is converted into a nonflowable solid material. In some embodiments, the curable material is further cured (e.g., fully cured) after the buff-coating step.

Examples of curable materials include epoxy resins, amino resins (e.g., aminoplast resins) such as alkylated urea-formaldehyde resins, melamine-formaldehyde resins, alkylated benzoguanamine-formaldehyde resin, acrylate resins (including acrylates and methacrylates), acrylated epoxies, acrylated urethanes, acrylated polyesters, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, and the like. The resins may be in the form of monomers, oligomers, polymers, or combinations thereof.

Examples of curable epoxy resins include bisphenol A diglycidyl ether, bisphenol F diglycidyl ether, vinylcyclohexene diepoxide, 2,2-bis-4-(2,3-epoxypropoxy)-phenyl) propane, cycloaliphatic epoxies, glycidyl ethers of phenol formaldehyde novolacs. Many such epoxy resins are commercially available from Hexion, Houston, Tex.

Some preferred curable materials cure via free-radical polymerization. These curable materials are capable of polymerizing rapidly upon exposure to thermal and/or radiation energy. A preferred subset of free-radical curable materials includes ethylenically-unsaturated curable materials. Examples of ethylenically-unsaturated curable materials include aminoplast monomers or oligomers having pendant α,β-unsaturated carbonyl groups, ethylenically unsaturated monomers or oligomers, (meth)acrylated isocyanurate monomers, (meth)acrylated urethane oligomers, (meth) acrylated epoxy monomers or oligomers, ethylenically unsaturated monomers or diluents, (meth)acrylate dispersions, and combinations thereof.

The aminoplast curable materials have at least one pendant α,β-unsaturated carbonyl group per molecule. These materials are reported in U.S. Pat. No. 4,903,440 (Larson et al.) and U.S. Pat. No. 5,236,472 (Kirk et al.).

Ethylenically-unsaturated monomers may be monofunctional, difunctional, trifunctional, tetrafunctional or even a higher functionality, and include (meth)acrylate monomers and oligomers. Suitable ethylenically-unsaturated compounds preferably have a molecular weight of less than about 4,000 g/mol, and are preferably esters made from the reaction of compounds containing aliphatic hydroxyl groups and unsaturated carboxylic acids, such as acrylic acid, methacrylic acid, itaconic acid, crotonic acid, isocrotonic acid, and maleic acid. Representative examples of ethylenically unsaturated monomers include methyl (meth)acrylate, ethyl methacrylate, styrene, divinylbenzene, hydroxyethyl (meth)acrylate, hydroxypropyl (meth)acrylate, hydroxybutyl (meth)acrylate, lauryl acrylate, octyl acrylate, 2-(2-ethoxyethoxy)ethyl (meth)acrylate, tetrahydrofurfuryl (meth)acrylate, cyclohexyl (meth)acrylate, stearyl (meth) acrylate, 2-phenoxyethyl (meth)acrylate, isooctyl (meth) acrylate, isobornyl (meth)acrylate, isodecyl (meth)acrylate, polyethylene glycol mono(meth)acrylate, polypropylene glycol mono(meth)acrylate, vinyl toluene, ethylene glycol di(meth)acrylate, polyethylene glycol di(meth)acrylate, ethylene glycol di(meth)acrylate, hexanediol di(meth)acrylate, triethylene glycol di(meth)acrylate, 2-(2-ethoxyethoxy) ethyl (meth)acrylate, 2-phenoxyethyl (meth)acrylate, propoxylated trimethylolpropane tri(meth)acrylate, glycerol tri(meth)acrylate, pentaerythritol tri(meth)acrylate, pentaerythritol tri(meth)acrylate, and pentaerythritol tetra(meth) acrylate. Other ethylenically-unsaturated materials include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl)isocyanurate, 1,3,5-tris(2-methyacryloxyethyl)-s-triazine, acrylamide, methylacrylamide, N-methyl-acrylamide, N,N-dimethylacrylamide, N-vinyl-pyrrolidone, and N-vinylpiperidone.

It is also within the scope of this invention to formulate a curable material that comprises a mixture of an acrylate resin and an epoxy resin, e.g., as reported in U.S. Pat. No. 4,751,138 (Tumey et al.).

Isocyanurate derivatives having at least one pendant (meth)acrylate group and isocyanate derivatives having at least one pendant acrylate group are reported in U.S. Pat. No. 4,652,274 (Boettcher et al.). (Meth)acrylated urethanes are multifunctional (meth)acrylate esters of hydroxy terminated isocyanate extended polyesters or polyethers. Examples of commercially available (meth)acrylated urethanes include those available as UVITHANE 782 (available from Morton Chemical), "PHOTOMER 6010" (commercially available from Henkel Corp., Hoboken, N.J.), EBECRYL 220 (hexafunctional aromatic urethane acrylate of molecular weight 1000), EBECRYL 284 (aliphatic urethane diacrylate of 1200 molecular weight diluted with 1,6-hexanediol diacrylate), EBECRYL 4827 (aromatic urethane diacrylate of 1600 molecular weight), and EBECRYL 8402 (aliphatic urethane diacrylate oligomer) ("EBECRYL" resins are commercially available from Allnex, Brussels, Belgium), SARTOMER 9635, SARTOMER 9645, SARTOMER 9655, SARTOMER 963-B80 and SARTOMER 966-A80 (commercially available from Sartomer Co., Exton, Pa.).

Acrylated epoxies are diacrylate esters of epoxy resins, such as the diacrylate esters of bisphenol A epoxy resin. Examples of acrylated epoxies include those available as EBECRYL 605, EBECRYL 860, and EBECRYL 3200 from Allnex.

Acrylated polyesters are the reaction products of acrylic acid with a dibasic acid/aliphatic diol-based polyester. Examples of commercially available acrylated polyesters include those available as EBECRYL 80 (tetrafunctional modified polyester acrylate of 1000 g/mol molecular weight), EBECRYL 450 (fatty acid modified polyester hexaacrylate) and EBECRYL 830 (hexafunctional polyester acrylate of 1500 g/mol molecular weight) from Allnex.

A preferred free-radically curable material comprises a blend of an acrylated oligomer resin and an acrylate monomer resin, for example, a blend of an acrylated urethane resin and an acrylate monomer resin. The acrylate monomer resin may be tetrafunctional, trifunctional, difunctional, monofunctional or a combination thereof. For example, the curable material may contain a blend of an acrylated urethane resin and one or more monofunctional acrylate resins.

Examples of ethylenically-unsaturated diluents or monomers may be found in U.S. Pat. No. 5,236,472 (Kirk et al.) and U.S. Pat. No. 5,580,647 (Larson et al.). In some instances these ethylenically unsaturated diluents are useful because they tend to be compatible with water. Additional reactive diluents are disclosed in U.S. Pat. No. 5,178,646 (Barber et al.). The curable material may also be an acrylate dispersion such as described in U.S. Pat. No. 5,378,252 (Follensbee).

The curable material may be a partially cured resin as long as it is still curable. The curable material may be disposed on the entire major surface of the substrate or only a portion thereof (e.g., by printing or selective coating). Examples of coating methods include gravure coating, roll coating, curtain coating, knife coating, bar coating, dip coating, flood coating, and wiping. Any printing method can be used such as, for example, flexography, intaglio, lithography, inkjet, valve jet, and spray jet printing. Solvent (e.g., organic solvent and/or water) may be added to the curable material to facilitate coating/printing, but is preferably removed (e.g., by evaporation) prior to the buff-coating step. Examples of solvents include ketones (e.g., methyl ethyl ketone), ethers (e.g., methoxymethyl ethyl ether, tetrahydrofuran), alcohols (e.g., methanol, ethanol, propanol), and combinations thereof. If printed, the curable material is generally disposed on the major surface according to a predetermined pattern, although this is not a requirement. Exemplary patterns include alphanumeric characters, lines, dot arrays, grids (e.g., square, rectangular, triangular, or hexagonal grids), electronic elements such as circuit traces, antennas, and electromagnetic interference (EMI) shielding.

Curatives for the above curable materials will be readily apparent to those skilled in the art, and will generally depend on the curable material selected. For example, amine-curatives such as bisimidazoles and dicyandiamide may be used for epoxy resins, free-radical photoinitiators and thermal initiators (e.g., peroxides and certain azo compounds) are useful for free-radically polymerizable resins. Exemplary photoinitiators include benzoin and its derivatives such as α-methylbenzoin; α-phenylbenzoin; α-allylbenzoin; α-benzylbenzoin; benzoin ethers such as benzil dimethyl ketal (e.g., as IRGACURE 651 from Ciba Specialty Chemicals, Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., as DAROCUR 1173 from Ciba Specialty Chemicals) and 1-hydroxycyclohexyl phenyl ketone (e.g., as IRGACURE 184 from Ciba Specialty Chemicals); 2-methyl-1-[4(methylthio) phenyl]-2-(4-morpholinyl)-1-propanone (e.g., as IRGACURE 907 from Ciba Specialty Chemicals); 2-benzyl-2-(dimethylamino)-1-1-[4-(4-morpholinyl)phenyl]-1-butanone (e.g., as IRGACURE 369 from Ciba Specialty Chemicals). Other useful photoinitiators include pivaloin ethyl ether, anisoin ethyl ether; anthraquinones, such as anthraquinone, 2-ethylantrraquinone, 1-chloroanthraquinone, 1,4-dimethylanthraquinone, 1-methoxyanthraquinone, benzanthraquinone, and halomethyltriazines; benzophenone and its derivatives; iodonium salts and sulfonium salts as described hereinabove; titanium complexes such as bis(η5-2,4-cyclopentadien-1-yl)bis[2,6-difluoro-3-(1H-pyrrol-1-yl)phenyl]titanium (e.g., as CGI 784 DC from Ciba Specialty Chemicals); halomethylnitrobenzenes such as 4-bromomethylnitrobenzene and the like; mono- and bis-acylphosphines (e.g., from Ciba Specialty Chemicals as IRGACURE 1700, IRGACURE 1800, IRGACURE 1850, and DAROCUR 4265).

If one or more curatives are included, the amount of curative is typically at least an amount effective to cause a desired level of curing (e.g., full curing), typically in an amount of from 0.5 to 5 percent by weight, based on the total weight of the curable material, although higher and lower amounts may also be useful.

If desired, the tie layer may include one or more additives such as, for example, fillers, tougheners, grinding aids, pigments, fibers, tackifiers, lubricants, wetting agents, surfactants, antifoaming agents, dyes, coupling agents, plasticizers, and suspending agents. Examples of fillers include wood flour, silica, and nutshells. Preferred silicas include silica gel and silica nanoparticles having a mean particle size of 100 nm or less, more preferably, 20 nm or less. Such fillers may reinforce the cured composition and/or decrease tackiness of the curable material, for example. An inert polymeric binder may optionally be included (preferably dissolved) in the curable material. Examples include polyacrylics (e.g., polymethyl methacrylate), polyurethanes, polyamides, polyester, polyolefins, and polycarbonates.

The curable material is then at least partially cured according to the particular method suitable for curing the selected curable material, as will be known to those of skill in the art. Examples include such well-known methods as heating (e.g., in an oven, with a heated platen, using a heat gun, or using infrared radiation), e-beam radiation, and/or ultraviolet and/or visible light. Curing may be carried out in a single step or multiple steps.

The powder is supplied to the at least partially cured material surface (and optionally non-coated areas of the substrate surface) substrate which is then buffed using an applicator which may be solid or porous. Examples of suitable applicators include woven fabrics, nonwoven fabrics, and low durometer rubbery materials. Additional examples include closed cell or open cell foam material, and a brush or an array of bristles. Preferably, the bristles of such a brush have a length of about 0.2-1 cm, and a diameter of about 30-100 microns. Bristles are preferably made from nylon or polyurethane.

Preferred buffing applicators include foam pads described in U.S. Pat. No. 3,369,268 (Burns et al.) and lamb's wool pads. Preferably, the applicator is sufficiently soft that good frictional contact can be made between the applicator, powder, and substrate. Typically, an applied pressure of 30 g/cm2 is preferred; however this is not a requirement. Suitable buff-coating techniques and apparatuses are known in the art, for example, as described in U.S. Pat. No. 6,511,701 (Divigalpitiya et al.) and U.S. Pat. No. 4,741,918 (Nagybaczon et al.). This buffing operation is preferably carried out at a temperature below the softening temperature of the substrate, if one exists. Optionally, the substrate may be heated after the buffing operation (e.g., to a temperature up to the softening temperature of the substrate if one exists). Buff-coating is continued for sufficient time that a desired level of powder is adhered to the substrate as a buff-coat.

In one embodiment, buffing is accomplished by a random orbital buffing pad moved in the plane of the substrate parallel to the substrate surface. The orbital motion of the pad is carried out with its rotational axis perpendicular to the substrate or web. Thus, the pad moves in a plurality of directions during buff-coating, including directions transverse to the direction of the web in the case where the web is moving past the buffing pad.

The thickness of the buff-coated layer can be controlled by varying the time of buffing and by the amount of powder applied. Generally, the thickness of the coating increases linearly with time after a certain rapid initial increase. The longer the buffing operation, the thicker the coating. Also, the thickness of the coating can be controlled by controlling the amount of powder on the pads used for buffing. Finally, the thickness of the coating can be controlled by controlling the temperature of the substrate during coating. Thus, coating operations carried out at higher temperature tend to provide thicker coatings. In contrast, if the coating is carried out very near the softening temperature of the substrate, it may be difficult to obtain a very uniform coating. Thus, it is preferred to carry out the coating process at an ambient temperature that is less than 10° C. less than any softening temperature, and more preferably less than 20° C. less than any softening temperature of the substrate. For purposes of the present disclosure, "softening temperature" is the temperature at which a material that does not perceptively flow changes to a material that exhibits plastic flow properties.

Referring now to FIG. 1, exemplary buff-coated article 100 comprises a substrate 110 having a major surface 112. Layer 120 of at least partially cured material disposed on major surface 112. Buff-coated powder layer 130 is disposed on layer 120.

Select Embodiments of the Present Disclosure

In a first embodiment, the present disclosure provides a method of making a buff-coated article, the method comprising the sequential steps:

a) providing a substrate having a major surface;

b) disposing a tie layer on at least a portion of the major surface; and c) buff-coating a powder onto at least a portion of the tie layer.

In a second embodiment, the present disclosure provides a method according to the first embodiment, wherein the tie layer is non-tacky.

In a third embodiment, the present disclosure provides a method according to the first or second embodiment, wherein with tie layer comprises a curable material.

In a fourth embodiment, the present disclosure provides a method according to the third embodiment, wherein the curable material comprises at least one free-radically-polymerizable compound.

In a fifth embodiment, the present disclosure provides a method according to the fourth embodiment, wherein the curable material further comprises a photoinitiator.

In a sixth embodiment, the present disclosure provides a method according to any one of the third to fifth embodiments, wherein the curable material further comprises silica nanoparticles.

In a seventh embodiment, the present disclosure provides a method according to any one of the third to sixth embodiments, further comprising at least partially curing the curable material after step b) and/or after step c).

In an eighth embodiment, the present disclosure provides a method according to the seventh embodiment, wherein said at least partially curing comprises at least one of photocuring or electron beam curing.

In a ninth embodiment, the present disclosure provides a method according to any one of the first to eighth embodiments, wherein step b) comprises printing the tie layer onto said at least a portion of the major surface.

In a tenth embodiment, the present disclosure provides a method according to the ninth embodiment, wherein said printing comprises flexographic printing.

In an eleventh embodiment, the present disclosure provides a method according to any one of the first to ninth embodiments, wherein the tie layer is disposed on a portion of the major surface according to a predetermined pattern.

In a twelfth embodiment, the present disclosure provides a method according to any one of the first to eleventh embodiments, wherein the powder comprises at least one of exfoliatable or exfoliated particles.

In a thirteenth embodiment, the present disclosure provides a method according to any one of the first to twelfth embodiments, wherein the powder comprises at least one of graphite or hexagonal boron nitride.

In a fourteenth embodiment, the present disclosure provides a buff-coated article comprising: a substrate having a major surface;

a tie layer disposed on at least a portion of the major surface; and a buff-coated powder layer disposed on at least a portion of the tie layer.

In a fifteenth embodiment, the present disclosure provides a buff-coated article according to the fourteenth embodiment, wherein the tie layer comprises a polymerized reaction product of components comprising at least one free-radically polymerizable (meth)acrylate compound.

In a sixteenth embodiment, the present disclosure provides a buff-coated article according to the fourteenth or fifteenth embodiment, wherein the tie layer comprises silica nanoparticles.

In a seventeenth embodiment, the present disclosure provides a buff-coated article according to any one of the fourteenth to sixteenth embodiments, wherein the tie layer is disposed on a portion of the major surface according to a predetermined pattern.

In an eighteenth embodiment, the present disclosure provides a buff-coated article according to any one of the fourteenth to seventeenth embodiments, wherein the buff-coated powder layer comprises at least one of exfoliatable or exfoliated particles.

In a nineteenth embodiment, the present disclosure provides a buff-coated article according to any one of the fourteenth to seventeenth embodiments, wherein the buff-coated powder layer comprises at least one of graphite or hexagonal boron nitride.

In a twentieth embodiment, the present disclosure provides a buff-coated article according to any one of the fourteenth to seventeenth embodiments, wherein the buff-coated powder layer comprises clay.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Materials Used in the Examples

| DESIGNATION | DESCRIPTION |
|---|---|
| ALTUGLAS HT121 | Polymethyl methacrylate, $T_g$ = 128° C., available from Arkema Inc., Louisville, Kentucky as ALTUGLAS HT121 |
| CD580 | Alkoxylated cyclohexanedimethanol diacrylate, $T_g$ = 35° C., available from Arkema Inc., Louisville, Kentucky as CD580 |
| DYNAMAR FX5912 | Flexible, transparent fluoroplastic composed of tetrafluoroethylene, hexafluoropropylene, and vinylidene fluoride, available from 3M Company, St. Paul, Minnesota as DYNAMAR POLYMER PROCESSING ADDITIVE FX5912 |
| EPON 1009F | Epoxy resin (very high molecular weight, 2,2-bis(p-glycidyloxyphenyl) propane condensation product with 2,2-bis(p-hydroxyphenyl) propane and similar isomers), available from Hexion Specialty Chemicals, Columbus, Ohio as EPON 1009F |
| ESTANE 5712 | Polyester type thermoplastic polyurethane dusted with talc, available from Lubrizol Advanced Materials Inc., Brecksville, Ohio as ESTANE 5712 |

-continued

| DESIGNATION | DESCRIPTION |
|---|---|
| ESTANE 5715 | Polyester type thermoplastic polyurethane, available from Lubrizol Advanced Materials Inc. as ESTANE 5715 |
| IRGACURE 184 | 1-Hydroxycyclohexyl phenyl ketone, a photoinitiator, obtained from BASF USA, Florham Park, New Jersey as IRGACURE 184 |
| JONCRYL 585 | Styrene acrylic resin emulsion, $T_g$ = −20° C., available from BASF USA, Florham Park, New Jersey as JONCRYL 585 |
| KURARITY LA4285 | Methyl methacrylate/n-butyl acrylate block copolymer, available from Kuraray America Inc., Houston, Texas as KURARITY LA4285 |
| KURARITY LA2250 | Methyl methacrylate/n-butyl acrylate block copolymer, available from Kuraray America Inc., as KURARITY LA250 |
| KURARITY LA2140E | Methyl methacrylate/n-butyl acrylate block copolymer, available from Kuraray America Inc. as KURARITY LA2140E |
| MICRO 850 | Graphite powder, 3-5 micrometer particle size, 13 $m^2/g$ surface area, 0.088 Ohm · cm resistivity, obtained from Asbury Graphite Mills, Inc., Kittanning, Pennsylvania as MICRO850 |
| NANO-CLEAR | 1K humidity cured/highly cross-linked polyurethane hybrid nanocoating, available from Nanovere Technologies LLC, Brighton, Michigan as NANO-CLEAR |
| NEOREZ R-960 | Air dry, water-borne aliphatic urethane, available from DSM Coating Resins, Heerlen, Netherlands as NEOREZ R-960 |
| PARALOID B66 | Methyl methacrylate/n-butyl methacrylate copolymer, $T_g$ = 50° C., available from Dow Chemical, Midland, Michigan as PARALOID B66 |
| PARALOID B44 | Methyl methacrylate/ethyl acrylate copolymer, $T_g$ = 60° C., available from Dow Chemical as PARALOID B44 |
| PARALOID A11 | Polymethyl methacrylate, $T_g$ = 100° C., available from Dow Chemical as PARALOID A11 |
| PARALOID A21 | Polymethyl methacrylate, $T_g$ = 105° C., available from Dow Chemical as PARALOID A21 |
| PVDC F310 | Non-crystalline copolymer of vinylidene chloride and acrylonitrile, available from Asahi Kasei, Tokyo, Japan as PVDC F310 |
| SELVOL 103 PVA | Water-borne polyvinyl alcohol, $T_g$ = 85° C., available from Sekisui Specialty Chemicals America LLC, Dallas, Texas as SELVOL 103 PVA |
| SR349 | Bisphenol-A ethoxylate diacrylate, $T_g$ = 67° C., available from Arkema Inc., Louisville, Kentucky as SR349 |
| SR602 | Ethoxylated (10) Bisphenol A diacrylate, $T_g$ = 2° C., available from Arkema Inc., Louisville, Kentucky as SR602 |
| SR833S | Tricyclodecanediol diacrylate, $T_g$ = 188° C., available from Arkema Inc., Louisville, Kentucky as SR833S |
| UMOH | Vinyl chloride/vinyl acetate terpolymer, available from Wuxi Honghui New Materials Technology Co. Ltd., Wuxi City, Jiangsu, China as UMOH |
| UVHC 3000 | Solvent-based hardcoat curable by UV radiation, available from Momentive Performance Chemicals, Albany, New York as SILFORT UVHC 3000 |
| UVHC 5000 | Solvent-based hardcoat curable by UV radiation, available from Momentive Performance Chemicals, Albany, New York as SILFORT UVHC 5000 |
| VINNOL E15/48A | Hydroxyl-containing copolymer of approx. 84 wt. % vinyl chloride (VC) and approx. 16 wt. % of acrylic acid esters, available from Wacker Chemie AG, Munich, Germany as VINNOL E15/48A |
| VITEL 2200 | Copolyester resin, $T_g$ = 69° C., available from Bostik Inc., Wauwatosa, Wisconsin as VITEL 2200 |
| VYLON 200 | Highly polymerized and amorphous copolyester, $T_g$ = 67° C., available from Toyobo USA Inc., New York, New York as VYLON 200 |
| VYLON 220 | Highly polymerized and amorphous copolyester, $T_g$ = 53° C., available from Toyobo USA Inc., New York, New York as VYLON 220 |
| VYLON UR-8300 | Polyester urethane (urethane modified copolyester resin), $T_g$ = 23° C., available from Toyobo USA Inc., New York, New York as VYLON UR-8300 |
| Methyl ethyl ketone (MEK)<br>Toluene<br>Methyl isobutyl ketone (MIBK)<br>Cyclohexanone<br>1-Methoxy-2-propanol | solvents, obtained from Aldrich Chemical Company Milwaukee, Wisconsin |

Examples 1-11

For Example 1, an acrylate coating solution containing SR 349 resin in MEK (20 wt. % solids) was prepared. The coating solution further contained 1.5 wt. % of IRGACURE 184 with respect to solids. Then, the acrylate coating solution was coated on primed surface of a 6.5 in×11 in (16.51 cm×27.94 cm) PET substrate (127 micrometer thick, obtained from 3M Company, St. Paul, Minn., under trade designation 3M SCOTCHPAK POLYESTER FILM) using a #3 Meyer Rod (R D Specialties, Webster, N.Y.), corresponding to a dry coating thickness of about 1 micrometer. Prior to curing, the coated substrate was allowed to dwell undisturbed for several minutes at room temperature in order to flash off the MEK solvent. Then, the coated specimen was cured (to the desired level of curing) via ultraviolet irradiation using a UV curing station (Model MC-6RQN FUSION UV CURING SYSTEM equipped with an H bulb, obtained from Fusion UV Systems, Inc., Gaithersburg, Md.). The specimen was taped to a carrier board and laid on a conveyor belt passing through the UV processor at a power setting (50% power setting) and conveyor speed (30 feet per minute (9.14 meters per minute)) with the distance from lamp to specimen being about 5 in (12.7 cm) to deliver the targeted dose of (0.197 J/cm$^2$) to provide the PET substrate with the acrylate tie layer thereon. The UV exposure was carried out under $N_2$ atmosphere.

About 0.1 grams of MICRO 850 graphite powder was applied over the PET substrate containing the acrylate tie layer thereon. The graphite powder was buffed on top of the acrylate tie layer using a random orbit waxer/polisher with a wool polishing bonnet (Model WEN 10PMC 10 in (25.4 cm), obtained from WEN, Elgin, Ill.) to prepare the buff-coated specimen of Example 1. Buffing was carried out using firm manual force for about 2-7 seconds to uniformly coat the overall surface of the PET substrate.

Example 2-11 specimens were prepared in the same manner as the Example 1 specimen, except that the acrylate resin used and the dosage of ultraviolet irradiation used to cure (to the desired level of curing) were varied as reported in Table 1. The dosage of the UV radiation was controlled by varying the % power applied, the line speed and the number of times the specimens was passed through the UV curing system while keeping the lamp 5 in (12.7 cm) above the specimen.

The relative amount of deposited graphite on Example 1-11 specimens was determined by measuring the electrical resistivity of the buff-coated surface of the specimens using a four point probe surface resistivity meter (Model RC2175 R-CHEK SURACE RESISTIVITY METER, obtained from EDTM, Toledo, Ohio) and by measuring the % transmittance of the buff-coated specimens by using a haze meter (BYK HAZE-GARD PLUS, obtained from BYK Additives and Instruments, Wallingford, Conn.).

While not wishing to be bound by theory, it is believed that specimens with larger amounts of deposited graphite had lower % transmittance and lower surface resistance values.

Table 1, below, reports the acrylate used for the tie layer, the dose of UV A irradiation applied to cure the tie layer, % transmittance, and sheet resistance of buff-coated Example 1-11 specimens.

TABLE 1

| EXAMPLE | TIE LAYER RESIN | UV A DOSE, J/cm$^2$ | % TRANSMITTANCE | SHEET RESISTANCE, Ω/□ |
|---|---|---|---|---|
| 1 | SR 349 | 0.197 | 13.9 | 233 |
| 2 | SR 349 | 0.346 | 22.6 | 452 |
| 3 | SR 349 | 0.508 | 26.9 | 712 |
| 4 | SR 349 | 0.705 | 29.1 | 755 |
| 5 | SR 349 | 0.855 | 34.8 | 1324 |
| 6 | SR 349 | 1.156 | 35.7 | 1532 |
| 7 | SR 833S | 0.165 | 27.3 | 565 |
| 8 | SR 833S | 0.425 | 40.6 | 2202 |
| 9 | SR 833S | 0.590 | 44.5 | 2810 |
| 10 | SR 833S | 0.853 | 47.7 | 6154 |
| 11 | SR 833S | 1.253 | 48.7 | 6364 |

Examples 12-28

Examples 12-28 were prepared in the same manner as Examples 1-11 described above, except that the curing of the tie layer was accomplished by electron beam (e-beam) irradiation instead of the ultraviolet irradiation. Accordingly the acrylate coating solutions did not contain any photoinitiator (i.e., IRGACURE 184).

Curing via the e-beam irradiation was carried out using an electron beam system (MODEL CB-300 ELECTRON BEAM SYSTEM, obtained from Energy Sciences, Inc., Wilmington, Mass.). The coated PET specimens were taped on to a moving PET web and conveyed through the e-beam processor at a voltage of 110 keV. The web speed and e-beam current applied to the cathode were varied to ensure delivery of the targeted dose.

Table 2, below, reports the acrylate used for the tie layer, the dose of e-beam irradiation applied to cure the tie layer, % transmittance, and sheet resistance of buff-coated Example 12-28 specimens.

TABLE 2

| EXAMPLE | TIE LAYER RESIN | E-BEAM DOSE, MRad | % TRANSMITTANCE | SHEET RESISTANCE, Ω/□ |
|---|---|---|---|---|
| 12 | SR 349 | 0.25 | 2.29 | 264 |
| 13 | SR 349 | 0.5 | 11.3 | 546 |
| 14 | SR 349 | 1 | 14.5 | 474 |
| 15 | SR 349 | 2 | 17.6 | 487 |
| 16 | SR 349 | 4 | 21.1 | 904 |
| 17 | SR 349 | 8 | 23.6 | 648 |
| 18 | CD 580 | 0.5 | 1.96 | 142 |
| 19 | CD 580 | 1 | 6.69 | 191 |
| 20 | CD 580 | 2 | 10.5 | 318 |
| 21 | CD 580 | 4 | 14 | 375 |
| 22 | CD 580 | 8 | 14.2 | 366 |
| 23 | SR 833S | 0.25 | 0.62 | 102 |
| 24 | SR 833S | 0.5 | 29.9 | 1017 |
| 25 | SR 833S | 1 | 40.1 | 2414 |
| 26 | SR 833S | 2 | 42.7 | 3048 |
| 27 | SR 833S | 4 | 51.1 | 11198 |
| 28 | SR 833S | 8 | 57.7 | >20000 |

Examples 29-36

Examples 29-36 were prepared in the same manner as Examples 1-11 described above, except that the tie layer resin was varied as reported in Table 3. The coating composition contained 20 wt. % resin and 80 wt. % solvent (which was mixture of MEK (25 wt. %), toluene (25 wt. %), cyclohexanone (15 wt. %) and MIBK (15 wt. %)). Furthermore, a #7 Meyer rod (corresponding to a dry coating thickness of about 2 micrometers) was used to form the coatings. The coated specimens were dried at 110° C. oven for 45 seconds without further curing.

Table 3 reports the resin used for the tie layer, % transmittance, and sheet resistance of buff-coated Example 29-36 specimens.

Examples 37-41

Examples 37-41 were prepared in the same manner as Examples 29-36 described above, except that the tie layer resin was varied as reported in Table 3, below. The coating composition contained 30 wt. % resin and 70 wt. % solvent (which was mixture of MEK (28 wt. %) and 1-methoxy-2-propanol (42 wt. %). Furthermore, the Meyer rod #5 (corresponding to a dry coating thickness of about 2.25 micrometers) was used to form the coatings. The coated specimens were dried at 110° C. oven for 45 seconds without further curing.

Table 3 reports the resin used for the tie layer, % transmittance, and sheet resistance of buff-coated Example 37-41 specimens.

Examples 42-44

Examples 42-44 were prepared in the same manner as Examples 29-36 described above, except that the tie layer resin was varied as reported in Table 3. The coating composition contained 32 wt. % resin and 68 wt. % solvent (which was mixture of MEK (20 wt. %) and 1-methoxy-2-propanol (48 wt. %). Furthermore, a #5 Meyer rod (corresponding to a dry coating thickness of about 2.4 micrometers) was used to form the coatings. The coated specimens were dried at 110° C. oven for 45 seconds without further curing.

Table 3 reports the resin used for the tie layer, % transmittance, and sheet resistance of buff-coated Example 42-44 specimens.

Example 45

Example 45 was prepared in the same manner as Examples 29-36 described above, except that the tie layer resin was SELVOL 103 PVA. The coating composition contained 4 wt. % resin and 96 wt. % deionized water as solvent. Furthermore, the Meyer rod #26 (corresponding to a dry coating thickness of about 1.6 micrometers) was used to form the coating. The coated specimen was dried at 110° C. oven for 45 seconds without further curing.

Table 3 reports the resin used for the tie layer, and % transmittance and sheet resistance of buff-coated Example 45 specimen.

Example 46

Example 46 was prepared in the same manner as Examples 29-36 described above, except that the tie layer was UMOH. The coating composition contained 30 wt. % resin and 70 wt. % MEK solvent. Furthermore, the Meyer rod #5 (corresponding to a dry coating thickness of about 2.25 micrometers) was used to form the coating. The coated specimen was dried at 110° C. oven for 45 seconds without further curing.

Table 3 reports the resin used for the tie layer, % transmittance, and sheet resistance of buff-coated Example 46 specimen.

Example 47

Example 47 was prepared in the same manner as Examples 29-36 described above, except that the tie layer was DYNAMAR FX5912. The coating composition contained 16 wt. % resin and 84 wt. % MIBK as solvent. Furthermore, a #8 Meyer rod (corresponding to a dry coating thickness of about 1.9 micrometers) was used to form the coating. The coated specimen was dried at 110° C. oven for 45 seconds without further curing.

Table 3 reports the resin used for the tie layer, % transmittance, and sheet resistance of buff-coated Example 47 specimen.

Examples 48-50

Examples 48-50 were prepared in the same manner as Examples 29-36 described above, except that the tie layer resin was varied as reported in Table 3, below. The coating composition was unmodified from that which was received from the supplier. Furthermore, the Meyer rod #5 (corresponding to a dry coating thickness of about 2.25 micrometers) was used to form the coatings. The coated specimens were dried at 110° C. oven for 45 seconds without further curing.

Table 3 reports the resin used for the tie layer, and % transmittance and sheet resistance of buff-coated Example 48-50 specimens.

Example 51

Examples 51 was prepared in the same manner as Examples 29-36 described above, except that the tie layer was JONCRYL 585. The coating composition was unmodified from that which was received from the supplier. Furthermore, a #3 Meyer rod (corresponding to a dry coating thickness of about 2 micrometers) was used to form the coating. The coated specimen was dried at 110° C. oven for 45 seconds without further curing.

Table 3 reports the resin used for the tie layer, % transmittance, and sheet resistance of buff-coated Example 48-50 specimens.

TABLE 3

| EXAMPLE | TIE LAYER RESIN | % TRANSMIT-TANCE | SHEET RESISTANCE, Ω/□ |
|---|---|---|---|
| 29 | VYLON 200 | 16.6 | 217 |
| 30 | VYLON 220 | 24.2 | 403 |
| 31 | PVDC F310 | 35.9 | 876 |
| 32 | VITEL 2200 | 17.4 | 242 |
| 33 | ESTANE 5712 | 0.8 | 77 |
| 34 | ESTANE 5715 | 8.57 | 113 |
| 35 | EPON 1009F | 25.3 | 396 |
| 36 | VINNOL E15/48A | 35.4 | 971 |
| 37 | PARALOID B66 | 20.7 | 285 |
| 38 | PARALOID B44 | 40.8 | 1911 |
| 39 | PARALOID A11 | 55.8 | >20000 |
| 40 | PARALOID A21 | 61.5 | >20000 |
| 41 | ALTUGLAS HT121 | 63.1 | >20000 |
| 42 | KURARITY LA4285 | 7.01 | 116 |
| 43 | KURARITY LA2250 | 0.97 | 56 |
| 44 | KURARITY LA2140E | 0.42 | 62 |
| 45 | SELVOL 103 PVA | 58.8 | 9577 |
| 46 | UMOH | 32.2 | 734 |

TABLE 3-continued

| EXAMPLE | TIE LAYER RESIN | % TRANSMIT-TANCE | SHEET RESISTANCE, Ω/□ |
|---|---|---|---|
| 47 | DYNAMAR FX5912 | 5.3 | 88 |
| 48 | NANO-CLEAR | 37.3 | 1249 |
| 49 | VYLON UR-8300 | 6.12 | 106 |
| 50 | NEOREZ R-960 | 17.2 | 285 |
| 51 | JONCRYL 585 | 12.1 | 234 |

Example 52

Example 52 was prepared in the same manner as Example 1, except that acrylate tie layer was SR 602 coated on the PET substrate in a pattern representing the letters "SCH". The acrylate tie layer was cured by UV irradiating at a dosage of about 0.855 J/cm$^2$. The PET substrate had a nanosilica primer layer of about 100 nm thick. The nanosilica primer layer was formed by coating the bare PET substrate with a 5 wt. % colloidal silica (NALCO 1115) sol in water which was acidified to a pH of 2.5 by adding nitric acid and then drying the coating at room temperature.

Figure 2:
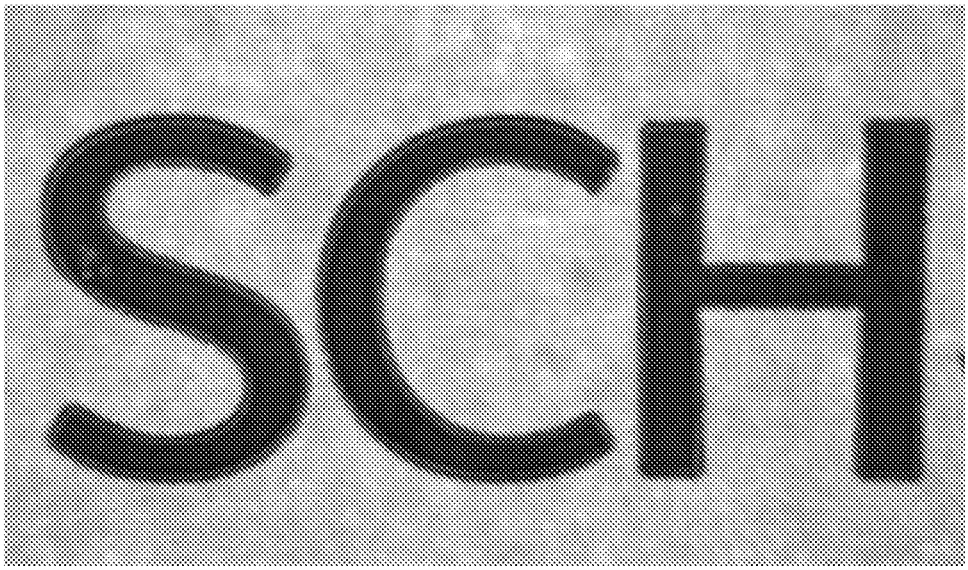
FIG. 2 is a digital photograph of the printed specimen prepared in Example 52.

The resulting Example 52 specimen is shown in FIG. 2.

Examples 53-54

Examples 53-54 were prepared in the same manner as Example 1 described above, except that the tie layer was replaced with a solvent based hardcoat curable by UV radiation as reported in Table 4, below. The coating composition was unmodified from that which was received from the supplier. Furthermore, a #3 Meyer rod (corresponding to a dry coating thickness of about 2 micrometers) was used to form the coatings. The coated specimens were dried at 110° C. oven for 45 seconds with further curing by UV irradiating at a dosage of about 0.855 J/cm$^2$ Table 4 reports the resin used for the tie layer, % transmittance, and sheet resistance of buff-coated Example 53-54 specimens.

These examples demonstrate how the deposition of graphite can be effectively blocked by the proper selection of tie layer. In this regard, a negative image can be achieved when the tie layer is appropriately patterned.

TABLE 4

| EXAMPLE | TIE LAYER RESIN | % TRANSMIT-TANCE | SHEET RESISTANCE, Ω/□ |
|---|---|---|---|
| 53 | UVHC 3000 | 82.6 | >20000 |
| 54 | UVHC 5000 | 84.4 | >20000 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making a buff-coated article, the method comprising the sequential steps:

a) providing a substrate having a major surface, wherein the substrate comprises a web or sheet;

b) disposing a tie layer on a portion of the major surface, wherein the tie layer is disposed on a portion of the major surface according to a predetermined pattern, wherein the tie layer comprises a curable material that comprises at least one free-radically-polymerizable compound and a photoinitiator; and c) buff-coating a powder onto at least a portion of the tie layer.

2. The method of claim 1, wherein the tie layer is non-tacky.

3. The method of claim 1, wherein step b) comprises printing the tie layer onto said at least a portion of the major surface.

4. The method of claim 3, wherein said printing comprises flexographic printing.

5. The method of claim 1, wherein the powder comprises exfoliatable particles.

6. The method of claim 1, wherein the powder comprises at least one of graphite or hexagonal boron nitride.

7. A buff-coated article comprising:

a substrate having a major surface, wherein the substrate comprises a web or sheet;

a tie layer disposed on a portion of the major surface according to a predetermined pattern, wherein the tie layer comprises a polymerized reaction product of components comprising at least one free-radically polymerizable (meth)acrylate compound; and a buff-coated powder layer disposed on at least a portion of the tie layer.

8. The buff-coated article of claim 7, wherein the tie layer comprises silica nanoparticles.

9. The buff-coated article of claim 7, wherein the buff-coated powder layer comprises exfoliatable particles.

10. The buff-coated article of claim 7, wherein the buff-coated powder layer comprises at least one of graphite or hexagonal boron nitride.

11. The buff-coated article of claim 7, wherein the buff-coated powder layer comprises clay.

* * * * *